US012747733B1

(12) United States Patent
Yan

(10) Patent No.: US 12,747,733 B1
(45) Date of Patent: Sep. 29, 2026

(54) PORTABLE FAN WITH HANGING PORTION AND ADJUSTMENT BRACKET

(71) Applicant: Shenzhen Zhile Interconnection Technology Co., Ltd., Shenzhen (CN)

(72) Inventor: Huan Yan, Hengyang (CN)

(73) Assignee: Shenzhen Zhile Interconnection Technology Co., Ltd., Shenzhen (CN)

( * ) Notice: Subject to any disclaimer, the term of this patent is extended or adjusted under 35 U.S.C. 154(b) by 0 days.

(21) Appl. No.: 19/440,817

(22) Filed: Jan. 6, 2026

(30) Foreign Application Priority Data

Nov. 19, 2025 (CN) ..... 202511697176.1

(51) Int. Cl.
*F04D 25/08* (2006.01)
*F04D 25/06* (2006.01)
*F04D 29/64* (2006.01)

(52) U.S. Cl.
CPC ..... *F04D 25/084* (2013.01); *F04D 25/0673* (2013.01); *F04D 29/646* (2013.01)

(58) Field of Classification Search
CPC ..... F04D 25/08
See application file for complete search history.

(56) References Cited

U.S. PATENT DOCUMENTS 6,192,702 B1 * 2/2001 Shimogori ..... F24F 1/04 62/406
8,608,437 B1 * 12/2013 Cantin, Jr. ..... F04B 35/06 415/206
12,264,689 B1 * 4/2025 Zhu ..... F04D 29/646
12,510,088 B1 * 12/2025 Yang ..... F04D 25/08
12,553,447 B1 * 2/2026 Tang ..... F04D 25/084
2018/0355875 A1 * 12/2018 Freeland ..... F04D 25/084

FOREIGN PATENT DOCUMENTS

CN 205064323 U * 3/2016
JP 2013130184 A * 7/2013
JP 6221024 B1 * 10/2017

OTHER PUBLICATIONS

English Machine Translation of description for JP-2013130184-A (Year: 2013).*

* cited by examiner

*Primary Examiner* — Nathan C Zollinger
(74) *Attorney, Agent, or Firm* — Nicholas Makridakis

(57) ABSTRACT

A portable fan includes a housing, where a cavity is formed in the housing; and further includes: at least one fan assembly mounted in the cavity and configured to drive airflow from the air inlet to the air outlet; a hanging portion mounted on an outer wall of the housing and configured to fix the housing to an external object; and at least one adjustment bracket, where one end of the adjustment bracket is hinged to the outer wall of the housing, and the adjustment bracket has a deployed state and a folded state; and when the housing is used during carrying, the other end of the adjustment bracket is fitted against the outer wall of the housing, and when the housing is used on a desktop, the other end of the adjustment bracket abuts against the desktop, and an angle is formed between the housing and the desktop.

7 Claims, 6 Drawing Sheets

PORTABLE FAN WITH HANGING PORTION AND ADJUSTMENT BRACKET

TECHNICAL FIELD

The present disclosure relates to the technical field of fans, and in particular to a portable fan.

BACKGROUND

With continuous improvement of people's living standards and an increasing frequency of outdoor activities, personal portable cooling devices have gradually become important auxiliary tools for travel, work, and exercise in summer. Especially in a high-temperature and high-humidity environment, conventional handheld fans have problems such as occupation of both hands, insufficient airflow, and short battery life, making it difficult to meet dual demands of users for comfort and convenience.

In recent years, various wearable fan products, such as neck-hanging fans and head-mounted fans, have appeared on the market. Although the fan products free up the hands to some extent, these fan products still have drawbacks such as unstable wearing, fixed usage positions, and limited usage scenarios.

SUMMARY

The present disclosure provides a portable fan. By disposing different hanging members, a usage position of the fan may be flexibly adjusted, and by hingedly connecting an adjustment bracket, the fan may be placed on a desktop for use, thereby solving the problems mentioned in the above background, such as fixed usage positions and limited usage scenarios.

The present disclosure provides the following technical solution:

A portable fan includes a housing, where a cavity is formed in the housing, and an air inlet and an air outlet are respectively formed at both ends of the cavity; and further includes: at least one fan assembly mounted in the cavity and configured to drive airflow from the air inlet to the air outlet; a power supply assembly fixedly connected in the housing and configured to supply power to the fan assembly; a hanging portion mounted on an outer wall of the housing and configured to fix the housing to an external object; and at least one adjustment bracket, where one end of the adjustment bracket is hinged to the outer wall of the housing, and the adjustment bracket has a deployed state and a folded state; and when the housing is used during carrying, the other end of the adjustment bracket is fitted against the outer wall of the housing, and when the housing is used on a desktop, the other end of the adjustment bracket abuts against the desktop, and an angle of 0-60° is formed between the outer wall of the housing and the desktop.

As a preferred technical solution of the present disclosure, the hanging portion includes hanging rope holes, a first back clip, and a second back clip, where the hanging rope holes are formed in both sides of the housing near an end of the air outlet, and a connecting rope is mounted and connected in the hanging rope holes for hanging around a neck.

As a preferred technical solution of the present disclosure, the first back clip is detachably connected to a side of the housing, an opening of the first back clip faces the air outlet, a first clamping space is formed between an inner wall of the first back clip and the housing to clamp an external object, and the first back clip is configured to hook onto a corner of clothing.

As a preferred technical solution of the present disclosure, the second back clip is detachably connected to the housing and located on an opposite side of the first back clip, an opening of the second back clip faces the air inlet, a second clamping space is formed between an inner wall of the second back clip and the housing to clamp an external object, and the second back clip is configured to snap onto a waistband of pants or a belt.

As a preferred technical solution of the present disclosure, the fan assembly includes an air cylinder fixedly connected in the cavity, where a fan motor is mounted in the air cylinder, an air outlet pipe communicated with the air outlet is fixedly connected to one end of the air cylinder, the other end of the air cylinder is communicated with the air inlet, and an obliquely arranged deflector is fixedly connected to the other end of the air cylinder.

As a preferred technical solution of the present disclosure, a fixing ring is fixedly connected at a connection point between the air outlet pipe and the air cylinder, and a plurality of spiral guide vanes uniformly distributed circumferentially are fixedly connected to an inner wall of the fixing ring.

As a preferred technical solution of the present disclosure, the air outlet pipe is flared, with a smaller end fixedly connected to the air outlet.

As a preferred technical solution of the present disclosure, the power supply assembly includes a battery pack fixedly connected in the cavity, a circuit board is fixedly connected in the cavity, both the battery pack and the fan motor are electrically connected to the circuit board, power connection ports electrically connected to the circuit board are fixedly connected to the housing, and operation buttons are mounted on the circuit board.

As a preferred technical solution of the present disclosure, a metal sheet is fixedly connected to an outer wall of the battery pack through a thermally conductive insulating pad, and an end of the metal sheet away from the thermally conductive insulating pad is fixedly connected to an outer wall of the air outlet pipe to achieve heat dissipation of the battery pack.

As a preferred technical solution of the present disclosure, ducts are fixedly connected between an outer wall of the air outlet and the housing, a plurality of ducts are arranged and uniformly distributed circumferentially, an outlet end surface of each of the ducts is lower than an air outlet end surface of the air outlet, and the air outlet end surface of the air outlet is lower than an air outlet end surface of the housing.

Compared with the prior art, the portable fan provided by the present disclosure has the following beneficial effects:

1. In this portable fan, by mounting the first back clip and the second back clip on two opposite sides of the housing, respectively, and forming the hanging rope holes, with the openings of the first back clip and the second back clip facing opposite directions, a usage position of the fan may be adjusted according to actual usage conditions, thereby improving flexibility during use.
2. In this portable fan, by hingedly connecting the adjustment bracket to the second back clip, the fan may be placed on any other support surface for use, thereby enhancing the diversity of usage scenarios.

Parts not involved in this device are the same as those in the prior art or may be implemented using the prior art.

Through the integrated design of a dual-motor collaborative air duct and a multi-scenario fixing structure, the present disclosure overcomes the technical pain points of conventional fans, such as insufficient airflow, single functionality, and limited scenarios, thereby achieving the unification of efficient air delivery, flexible adaptation, and safety and stability.

BRIEF DESCRIPTION OF THE DRAWINGS

In order to explain the technical solutions in embodiments of the present disclosure or in the prior art more clearly, the drawings to be used in the description of the embodiments or the prior art will be briefly introduced below. In all the drawings, elements or parts are not necessarily drawn to actual scale.

Figure 1:
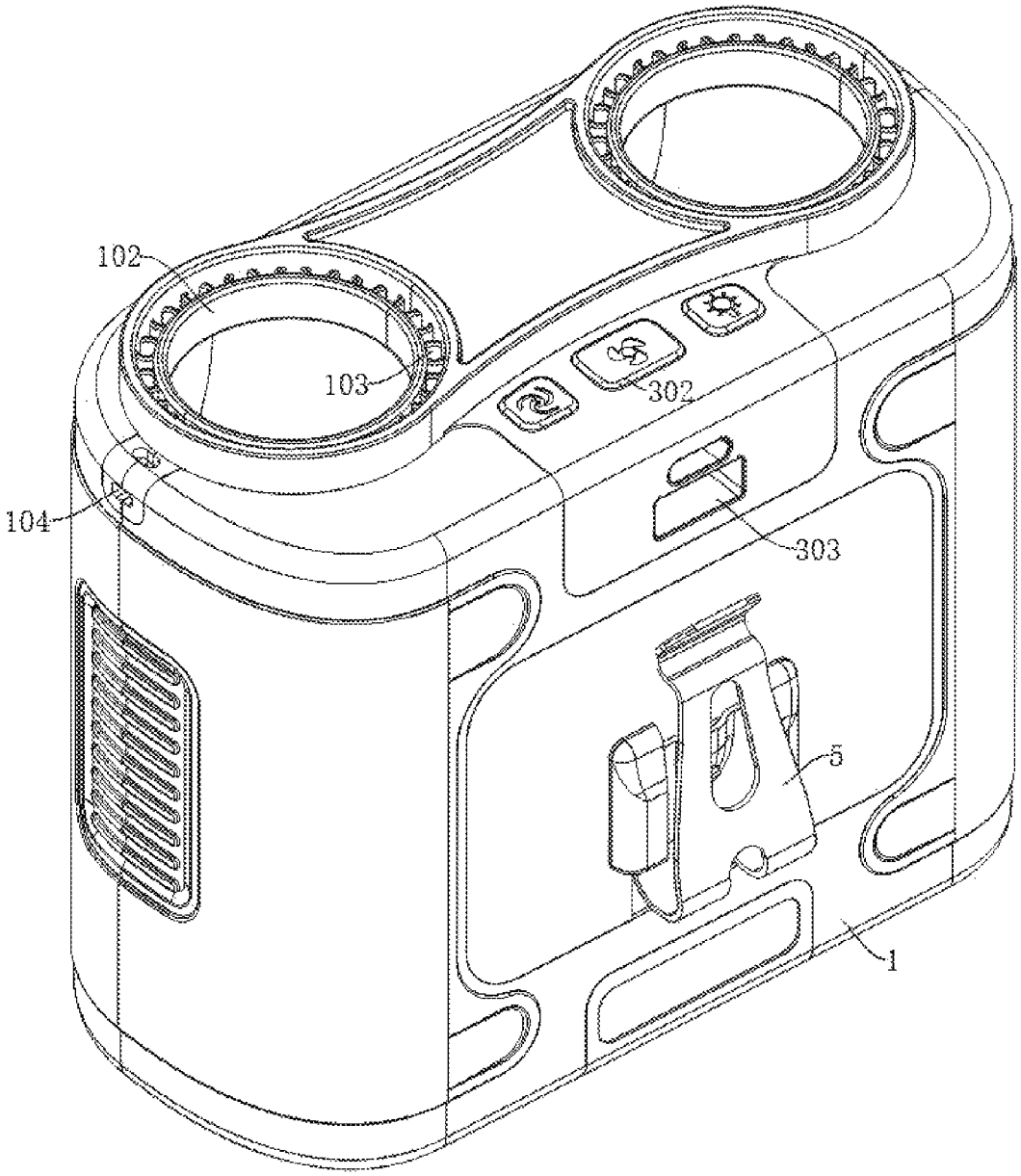
FIG. 1 is a schematic perspective view of the present disclosure from a first angle.

Reference numerals in the figures: 1—housing; 101—air inlet; 102—air outlet; 103—air deflector; 104—hanging rope hole; 2—air cylinder; 201—deflector; 202—fan motor; 203—spiral guide vane; 204—air outlet pipe; 205—fixing ring: 3—battery pack; 301—circuit board; 302—operation button; 303—power connection interface; 4—LED light; 5—first back clip; 501—second back clip; 6—adjustment bracket; 601—first end; 602—second end; and 7—metal sheet.

DETAILED DESCRIPTION

The technical solutions in embodiments of the present disclosure will be clearly and completely described below in combination with the drawings in the embodiments of the present disclosure. It is obvious that the described embodiments are only a part of, rather than all of, the embodiments of the present disclosure. Based on the embodiments in the present disclosure, all other embodiments obtained by those of ordinary skill in the art without making creative efforts will fall within the protection scope of the present disclosure.

EMBODIMENT

Figure 2:
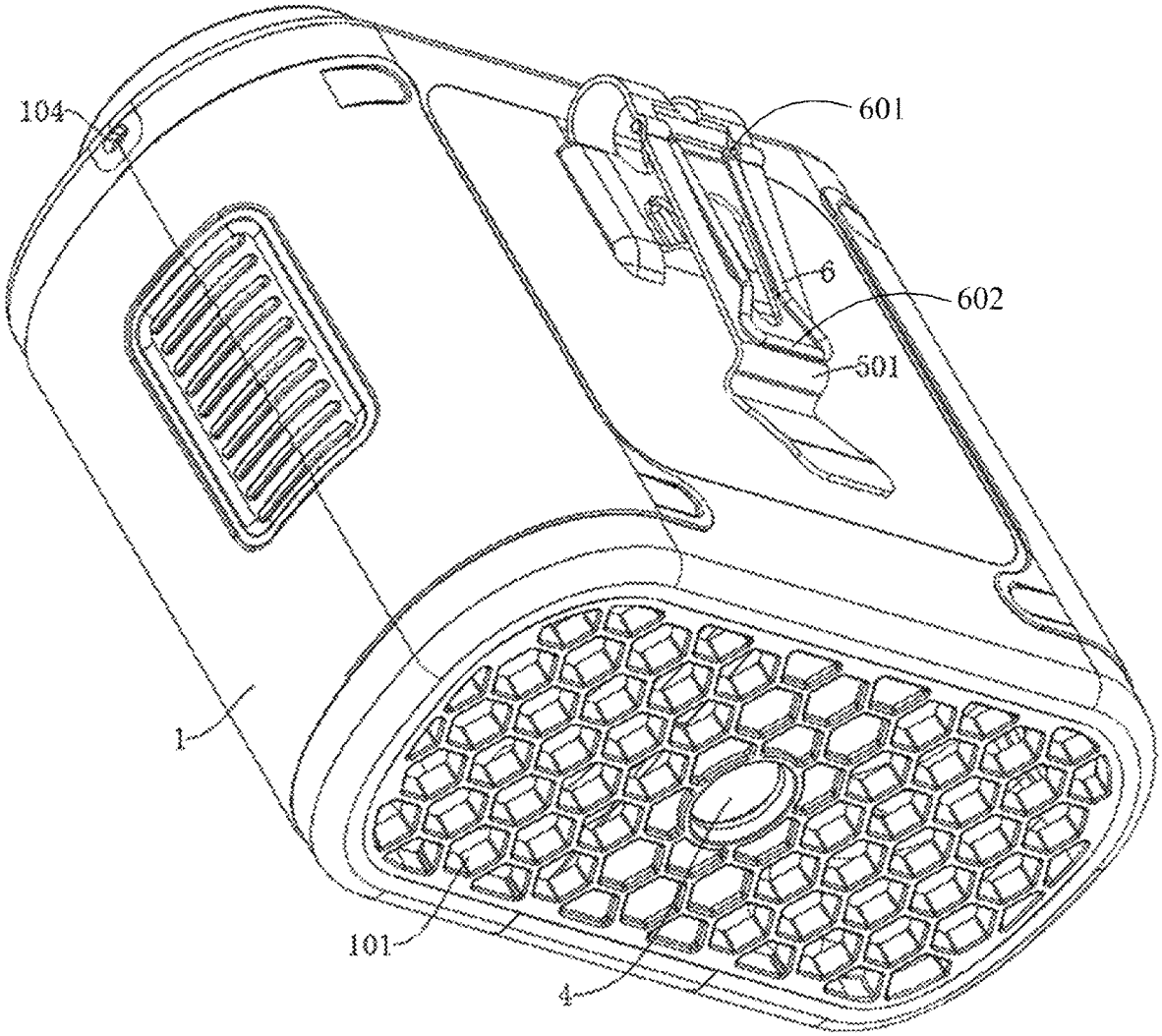
FIG. 2 is a schematic perspective view of the present disclosure from a second angle.
Figure 3:
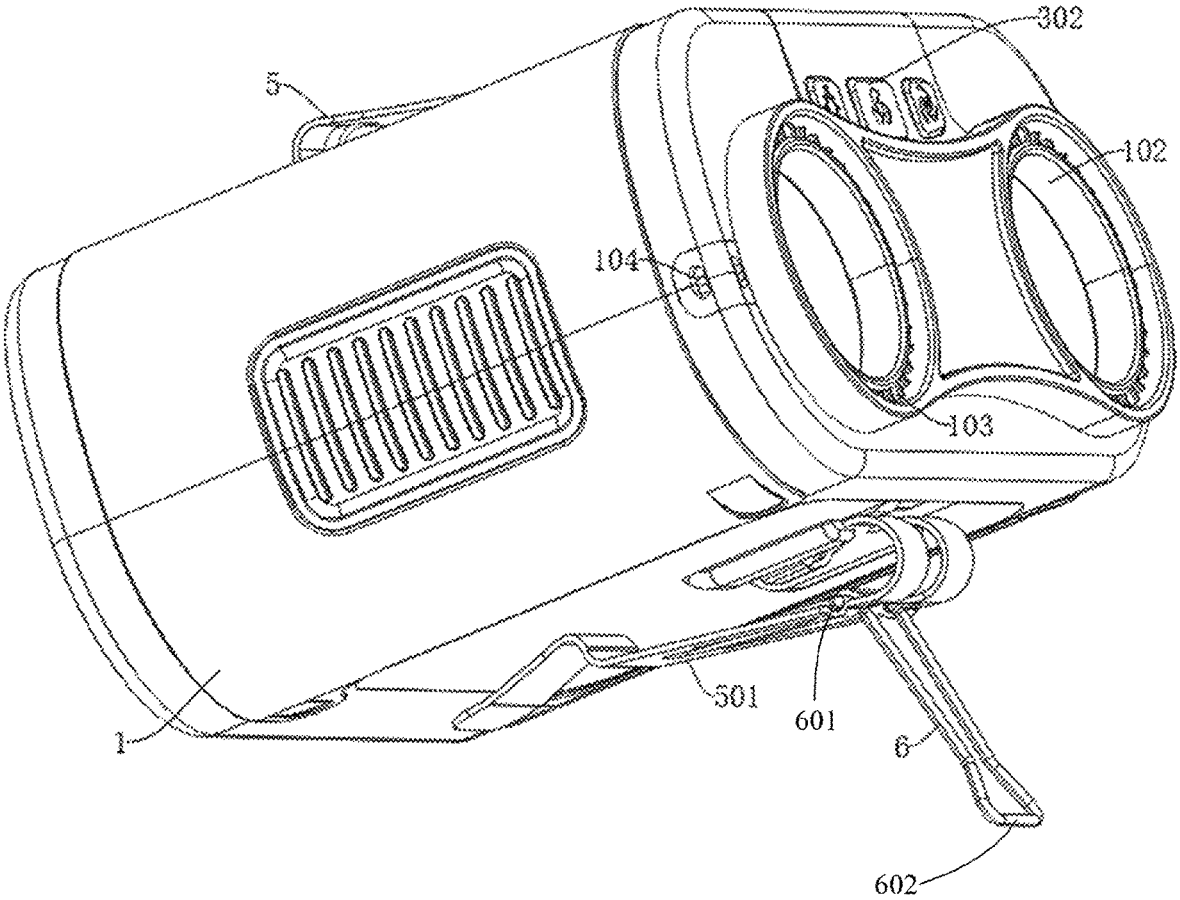
FIG. 3 is a schematic perspective view of the present disclosure with an adjustment bracket deployed.
Figure 4:
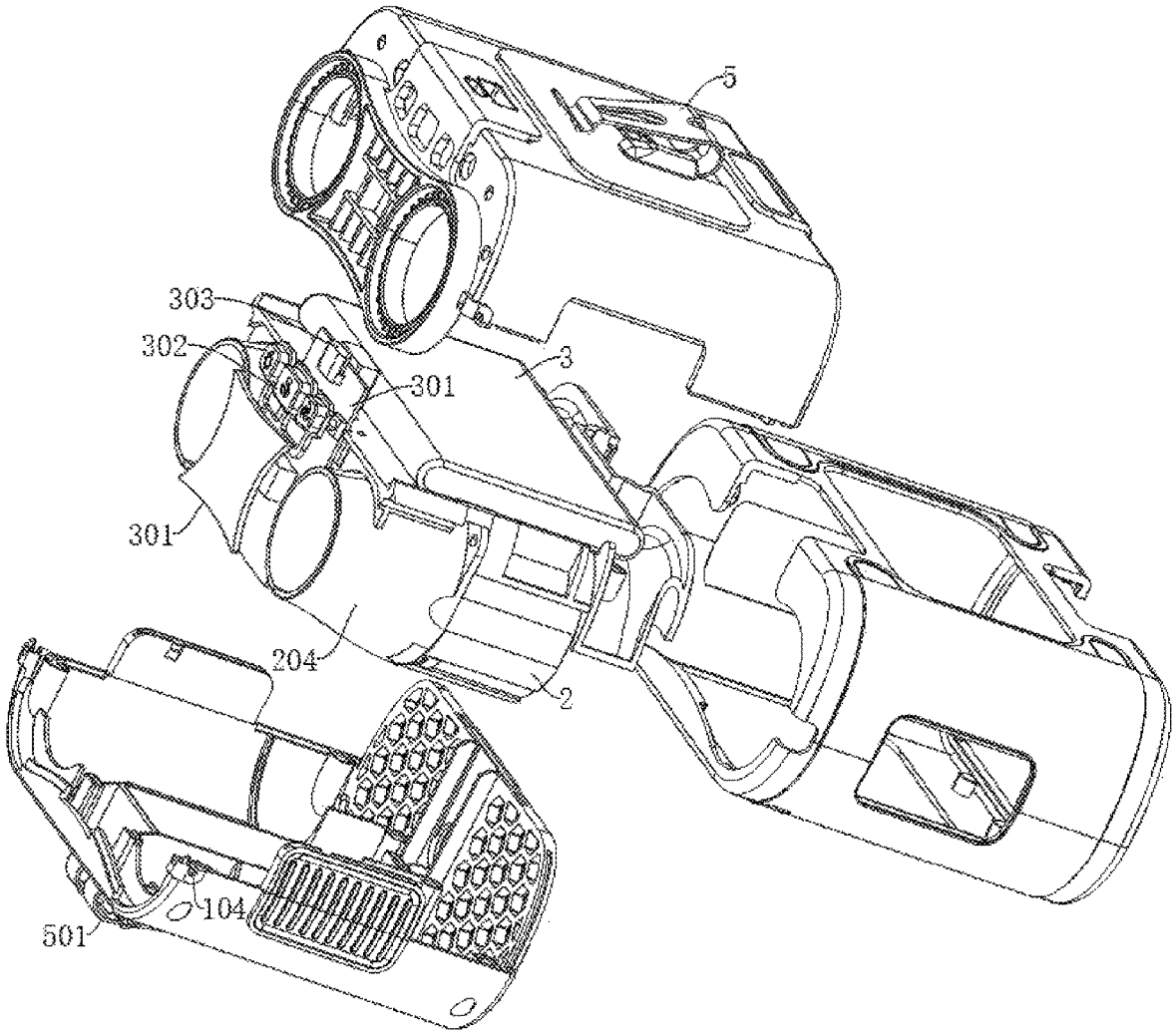
FIG. 4 is a schematic exploded view of the present disclosure.
Figure 5:
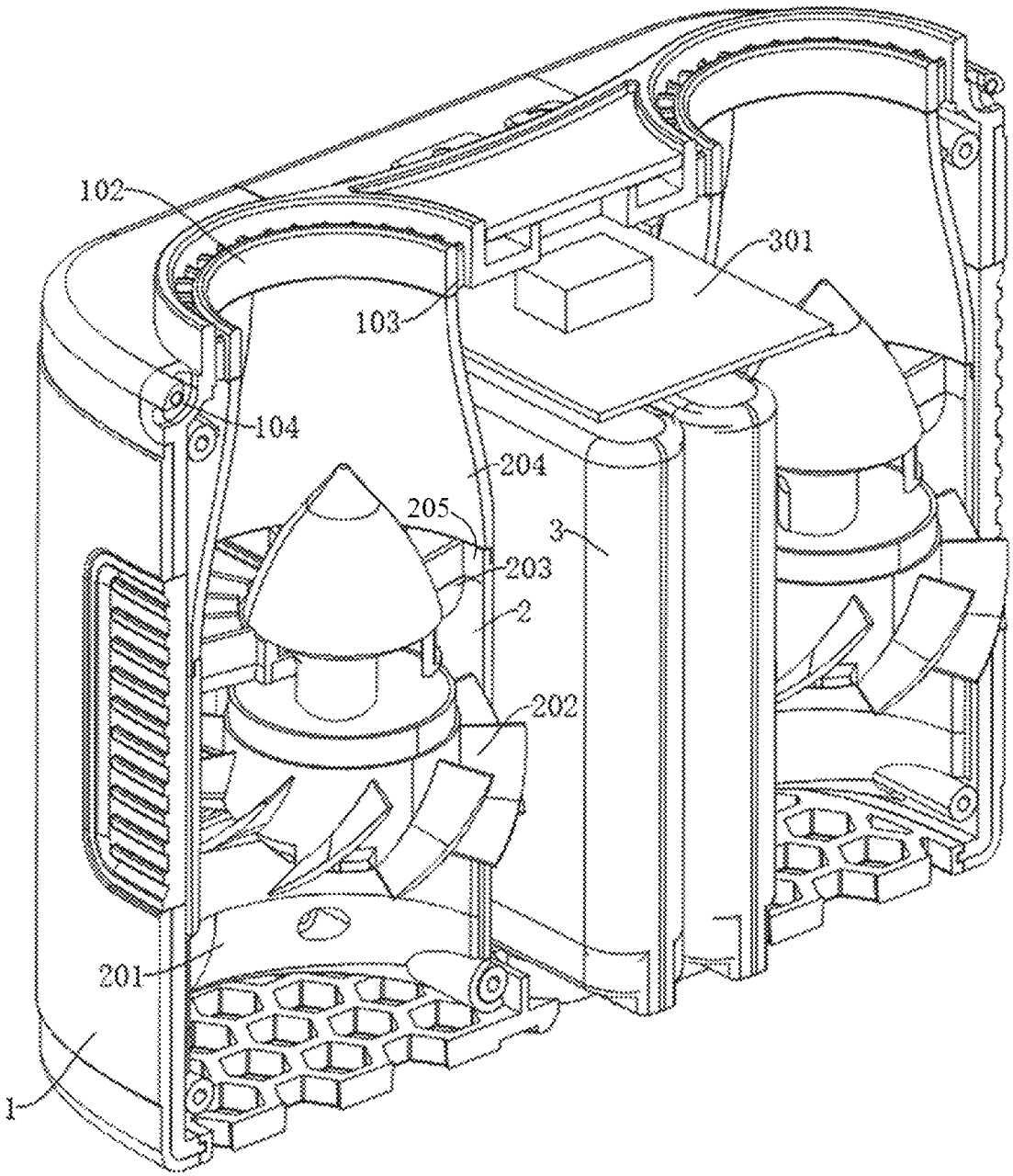
FIG. 5 is a schematic sectional perspective view of the present disclosure.
Figure 6:
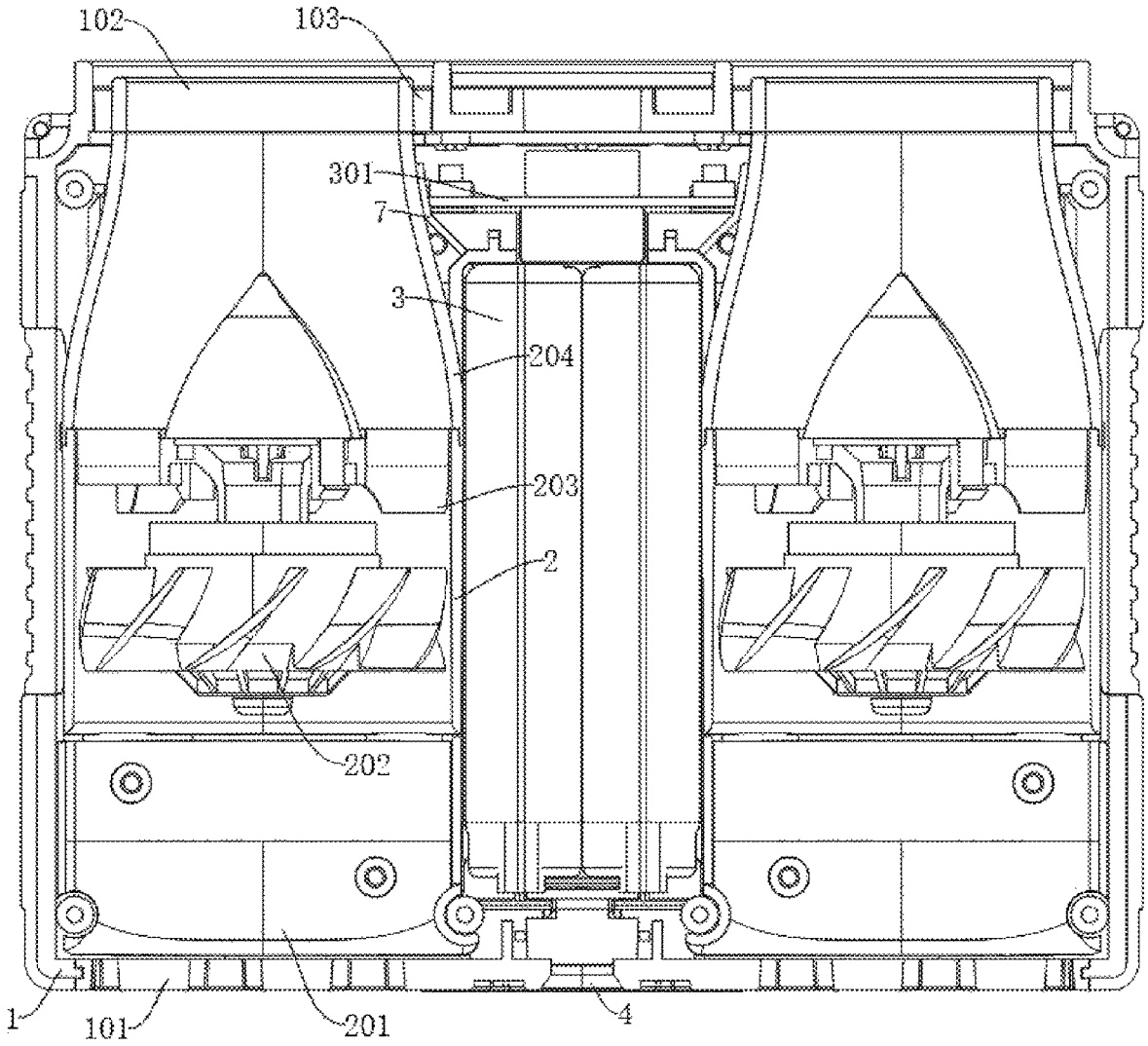
FIG. 6 is a schematic sectional plan view of the present disclosure.

With reference to FIG. 1 to FIG. 6, a portable fan includes a housing 1, where the housing 1 has an elongated structure which is symmetrical left and right, with a length of 100-120 mm, a width of 70-90 mm, and a height of 90-110 mm (preferably 100 mm*80 mm*100 mm). A protective grille is fixedly connected to an air intake end of the housing 1 to prevent items such as clothing from entering, thereby improving safety during use. A cavity is formed in the housing 1, and an air inlet 101 and an air outlet 102 are formed at both ends of the cavity, respectively. The fan further includes: at least one fan assembly mounted in the cavity and configured to drive airflow from the air inlet 101 to the air outlet 102, where two fan assemblies are preferably disposed here, and correspondingly, two air inlets 101 and air outlets 102 are also disposed, each corresponding to the respective fan assembly, such that an air volume may be increased during use to meet heat dissipation demands in a high-temperature environment or a high-intensity exercise scenario; a power supply assembly fixedly connected in the housing 1 and configured to supply power to the fan assembly; a hanging portion mounted on an outer wall of the housing 1 and configured to fix the housing 1 to an external object; and at least one adjustment bracket 6, and preferably one, where the adjustment bracket 6 is made of iron or stainless steel, and preferably stainless steel (with a load-bearing capacity of ≥500 g), one end of the adjustment bracket 6 is hinged to the outer wall of the housing 1, the adjustment bracket 6 has a deployed state and a folded state; and when the housing 1 is used during carrying, the other end of the adjustment bracket 6 is fitted against the outer wall of the housing 1, and when the housing 1 is used on a desktop, that is, when the fan is placed on a desktop or any other support surface for use, the other end of the adjustment bracket 6 abuts against the desktop/support surface, an angle of 0-60° is formed between the outer wall of the housing 1 and the desktop/support surface, and fixed air delivery on the desktop/support surface is supported. An inclination angle of the fan may be adjusted according to actual usage conditions. Here, the angle is preferably 60°.

Specifically, the hanging portion includes hanging rope holes 104, a first back clip 5, and a second back clip 501, where the hanging rope holes 104 are formed on both sides of the housing 1 near an end of the air outlet 102, and a connecting rope is mounted and connected in the hanging rope holes 104 for hanging around a neck. Specifically, hanging rope holes 104 are formed on both sides of the housing 1 near an end of the air outlet 102, both ends of a connecting rope are respectively fixed in the hanging rope holes 104, then the connecting rope is hung around a neck, and the air outlet 102 is oriented towards the head. Additionally, the hanging rope holes 104 are preferably pig-nose holes.

The first back clip 5 is detachably connected to one side of the housing 1, preferably in a snap-fit manner. The snap-fit connection method is the prior art and will not be described in detail here. Moreover, an opening of the first back clip 5 faces the air outlet 102, a first clamping space is formed between an inner wall of the first back clip 5 and the housing 1 to clamp an external object, and the first back clip 5 is configured to hook onto a corner of clothing, such as a hem or cuff of a shirt/coat. The second back clip 501 is detachably connected to the housing 1 and located on an opposite side of the first back clip 5. Similarly, the second back clip 501 is detachably connected to the housing 1 in a snap-fit manner. The snap-fit connection method is the prior art and will not be described in detail here. Here, an opening of the second back clip 501 faces the air inlet 101, a second clamping space is formed between an inner wall of the second back clip 501 and the housing 1 to clamp an external object, and the second back clip 501 is configured to snap onto a waistband of pants, a belt, or a collar. By mounting the first back clip 5 and the second back clip 501 on two opposite sides of the housing 1, respectively, and forming the hanging rope holes 104, with the openings of the first back clip 5 and the second back clip 501 facing opposite directions, a usage position of the fan may be adjusted according to actual usage conditions, thereby improving flexibility during use. Here, it is preferable to hinge the adjustment bracket 6 to the second back clip 501.

Here, each of the fan assemblies includes an air cylinder 2 fixedly connected in the cavity, where a fan motor 202 is mounted in the air cylinder 2, and the fan motor 202 is a high-speed brushless direct current (DC) fan motor 202 (with an external rotor structure, a rated power of the single fan motor 202 being 0.5-6 W, and a maximum speed of 15,300 rpm). Axes of the two fan motors 202 are parallel and are spaced 20-30 mm apart. Here, the axes are spaced 25 mm apart to prevent airflow interference. Moreover, an air outlet pipe 204 communicated with the air outlet 102 is fixedly connected to an end of each of the air cylinders 2. Here, the air outlet pipe 204 is flared, with a smaller end fixedly connected to the air outlet 102, thereby achieving concentrated air delivery. The other end of the air cylinder 2 is communicated with the air inlet 101, and an obliquely arranged deflector 201 is fixedly connected to the other end of the air cylinder 2, with an inclination angle of 30° to 35°, and preferably 30°, to guide external airflow to converge into the air cylinder 2.

A fixing ring is fixedly connected at a connection point between the air outlet pipe 204 and the air cylinder 2, and a plurality of spiral guide vanes 203 uniformly distributed circumferentially are fixedly connected to an inner wall of the fixing ring. Two to twelve spiral guide vanes 203 are disposed, with ten being preferred. The spiral guide vanes 203 (arranged radially, with an angle of 15°-25°, and preferably) 20° are arranged on an inner side of the air outlet pipe 204 to superimpose and accelerate airflow from the dual fan motors 202, so as to form concentrated air delivery.

Here, the power supply assembly includes a battery pack 3 fixedly connected in the cavity, a circuit board 301 is fixedly connected in the cavity, a light emitting diode (LED) light 4 is fixedly connected to a bottom of the housing 1, and a board of the LED light 4, the battery pack 3, and the fan motors 202 are all electrically connected to the circuit board 301. Moreover, power connection ports 303 electrically connected to the circuit board 301 are fixedly connected to the housing 1, and the power connection ports 303 include a Type-C charging port and a USB port for external power discharge. Operation buttons 302 are mounted on the circuit board 301 and configured to control turn-on and turn-off of the fan motors 202 and the LED light 4, and to adjust air volumes of the fan motors 202 and a mode of the LED light 4, such that auxiliary functions such as illumination and emergency signaling are achieved for the LED light 4. Specific adjustment conditions are as follows: Four-speed adjustment+Storm Mode: An independent switch is disposed on a top of the housing 1, and a panel display screen may show a battery level and an air speed (the operation buttons 302 include three physical buttons: a 4-speed adjustment button+a Storm Mode button+a light control button); a control module adjusts output voltages of the dual fan motors 202 (adjustable from 5 V to 14 V) via a PWM signal, thereby achieving four basic air speeds (Speed 1:30 CFM/single fan motor 202, Speed 2:40 CFM/single fan motor 202, Speed 3:50 CFM/single fan motor 202, Speed 4:60 CFM/single fan motor 202, Storm speed: 70 CFM/single fan motor 202); and when the "Storm Mode" button is clicked, the dual fan motors 202 are simultaneously increased to a maximum speed (≥15,300 rpm), with a total air volume of ≥140 CFM (the dual fan motors 202 superimposed), thereby meeting extreme heat dissipation demands. Multi-function illumination module: An illumination window (with a size of 12×12 mm) is disposed at the bottom of the housing 1, and a high-brightness LED light bead (with a color temperature of 6,000 K, and a single light bead brightness of ≥300 lumens) and a light guide plate are built in the illumination window. The illumination function is controlled through an independent button: Long press to turn on/off a constant lighting mode; and short press to switch to an SOS flashing mode/constant lighting mode (with a frequency of 1 Hz, and a standard signal of three short, three long, and three short flashes).

A metal sheet 7 is fixedly connected to an outer wall of the battery pack 3 through a thermally conductive insulating pad. The metal sheet 7 is made of a copper sheet or an aluminum sheet, and preferably a copper sheet, with a thickness of 0.5-3 mm, and preferably 1 mm. The thermally conductive insulating pad is made of a thermally conductive silicone pad, a mica sheet, or a polyimide film, and preferably a thermally conductive silicone pad. An end of the metal sheet 7 away from the thermally conductive insulating pad is fixedly connected to an outer wall of the air outlet pipe 204 to achieve heat dissipation of the battery pack 3. Moreover, the air outlet pipe 204 is made of aluminum, with a thickness of 3 mm. During use, by connecting both ends of the metal sheet 7 to outer walls of the air outlet pipe 204 and the battery pack 3, respectively, heat from the battery pack 3 may be transferred to the air outlet pipe 204 during prolonged use, thereby aiding in heat dissipation of the battery pack 3.

Moreover, ducts 103 are fixedly connected between the outer wall of the air outlet 102 and the housing 1, and a plurality of ducts 103 are arranged and uniformly distributed circumferentially; and two to sixteen ducts 103 are disposed, with twelve being preferred. Moreover, an outlet end surface of each of the ducts 103 is lower than an air outlet end surface of the air outlet 102, and the air outlet end surface of the air outlet 102 is lower than an air outlet end surface of the housing 1. Specifically, when air is blown out from the air outlet 102, a negative pressure may be formed at outlets of the ducts 103, such that air in the cavity where battery pack 3 is located is discharged outward through the ducts 103, air circulation in the cavity where the battery pack 3 is located is increased, and the heat dissipation effect is improved.

Components not described in detail herein are the prior art.

Finally, it should be stated that the above embodiments are only used for explaining, rather than limiting, the technical solutions of the present disclosure. Although the present disclosure is described in detail with reference to the above embodiments, those of ordinary skill in the art should understand that modifications may be made to the technical solutions of the present disclosure, or equivalent substitutions may be made to part of the technical features thereof; and such modifications or equivalent substitutions will not cause the essences of the corresponding technical solutions to deviate from the spirit and scope of the technical solutions of various embodiments of the present disclosure.

What is claimed is:

1. A portable fan, comprising a housing, wherein a cavity is formed in the housing, and an air inlet and an air outlet are respectively formed at both ends of the cavity; and further comprising:

two sets of fan assemblies mounted in the cavity, the air inlet and the air outlet are correspondingly provided with two sets, and each of the fan assemblies is configured to drive airflow from a respective air inlet to a respective air outlet;

wherein each of the fan assemblies comprises an air cylinder fixedly connected in the cavity, a fan motor is mounted in the air cylinder, an air outlet pipe communicated with the respective air outlet is fixedly connected to one end of the air cylinder, the other end of the air cylinder is communicated with the respective air inlet, and an obliquely arranged deflector is fixedly connected to the other end of the air cylinder;

a power supply assembly fixedly connected in the housing and configured to supply power to the fan assemblies; wherein the power supply assembly comprises a battery pack fixedly connected in the cavity, a circuit board is fixedly connected in the cavity, the battery pack and the fan motor are respectively electrically connected to the circuit board, power connection ports electrically connected to the circuit board are fixedly connected to the housing, and operation buttons are mounted on the circuit board;

a hanging portion mounted on an outer wall of the housing and configured to fix the housing to an external object; wherein the hanging portion comprises hanging rope holes, a first back clip, and a second back clip; the hanging rope holes are formed in both sides of the housing near an end of a respective air outlet, a connecting rope is mounted and connected in the hanging rope holes for hanging around a neck; and the first back clip and the second back clip are respectively detachably connected to two opposite sides of the housing; and an adjustment bracket, wherein a first end of the adjustment bracket is hinged to one side of the second back clip, and the adjustment bracket has a deployed state and a folded state; and when the housing is used during carrying, a second end of the adjustment bracket is in contact with the one side of the second back clip, and when the housing is used on a desktop, the second end of the adjustment bracket abuts against the desktop, and an angle of 0-60° is formed between the outer wall of the housing and the desktop; and wherein the operation buttons comprises three physical buttons including a 4-speed adjustment button, a storm mode button, and a light control button; and the storm mode button is configured to simultaneously increase the two fan motors of the fan assemblies to a maximum speed.

2. The portable fan according to claim 1, wherein the first back clip is detachably connected to a side of the housing, an opening of the first back clip faces the respective air outlet, a first clamping space is formed between an inner wall of the first back clip and the housing to clamp to the external object, and the first back clip is configured to hook onto a corner of clothing.

3. The portable fan according to claim 1, wherein the second back clip is detachably connected to the housing and located on an opposite side of the first back clip, an opening of the second back clip faces the respective air inlet, a second clamping space is formed between an inner wall of the second back clip and the housing to clamp to the external object, and the second back clip is configured to snap onto a waistband of pants or a belt.

4. The portable fan according to claim 1, wherein a fixing ring is fixedly connected at a connection point between one end of each air outlet pipe away from the respective air outlet and the respective air cylinder, and a plurality of spiral guide vanes uniformly distributed circumferentially are fixedly connected to an inner wall of the fixing ring.

5. The portable fan according to claim 1, wherein each air outlet pipe is flared, with a smaller end fixedly connected to the respective air outlet.

6. The portable fan according to claim 1, wherein one end of a metal sheet is fixedly connected to an outer wall of the battery pack, and an end of the metal sheet away from the battery pack is fixedly connected to an outer wall of one air outlet pipe to achieve heat dissipation of the battery pack.

7. The portable fan according to claim 1, wherein a plurality of air deflectors are fixedly connected between the outer wall of the respective air outlet and the housing, the air deflectors are arranged and uniformly distributed circumferentially, an outlet end surface of each of the air deflectors is lower than an air outlet end surface of the respective air outlet, and the air outlet end surface of the respective air outlet is lower than an air outlet end surface of the housing.

* * * * *